US010832881B2

(12) United States Patent
Boffelli et al.

(10) Patent No.: US 10,832,881 B2
(45) Date of Patent: Nov. 10, 2020

(54) MEDIUM VOLTAGE SWITCHING APPARATUS

(71) Applicant: ABB Schweiz AG, Baden (CH)

(72) Inventors: Carlo Boffelli, Dalmine (IT); Lars E. Jonsson, Västerås (SE); Stefan Halén, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/483,496

(22) PCT Filed: Jan. 15, 2018

(86) PCT No.: PCT/EP2018/050829
§ 371 (c)(1),
(2) Date: Aug. 5, 2019

(87) PCT Pub. No.: WO2018/141534
PCT Pub. Date: Aug. 9, 2018

(65) Prior Publication Data

US 2019/0371548 A1 Dec. 5, 2019

(30) Foreign Application Priority Data

Feb. 3, 2017 (EP) ..... 17154638

(51) Int. Cl.
*H01H 33/666* (2006.01)
*H01H 33/662* (2006.01)
(Continued)

(52) U.S. Cl.
CPC ..... *H01H 33/666* (2013.01); *H01H 3/26* (2013.01); *H01H 3/42* (2013.01); *H01H 2033/66246* (2013.01)

(58) Field of Classification Search
CPC ..... H01H 33/666; H01H 33/66238; H01H 33/6664; H01H 2033/6665; H01H 3/26;
(Continued)

(56) References Cited

U.S. PATENT DOCUMENTS 3,739,120 A * 6/1973 Starr ..... H01H 33/666 218/124
5,055,640 A 10/1991 Lippi et al.
(Continued)

FOREIGN PATENT DOCUMENTS

| | | | |
|---|---|---|---|
| DE | 532639 | C | 9/1931 |
| EP | 0387635 | A1 | 9/1990 |
| WO | 2010026048 | A1 | 3/2010 |

OTHER PUBLICATIONS

Translation WO20100026048 (Original doc. published Mar. 11, 2010) (Year: 2010).*
(Continued)

*Primary Examiner* — William A Bolton
(74) *Attorney, Agent, or Firm* — Taft Stettinius & Hollister LLP; J. Bruce Schelkopf

(57) ABSTRACT

A switching apparatus for medium voltage electric systems, the switching apparatus including one or more electric poles, each electrically coupleable with a corresponding electric line, the switching apparatus including: for each electric pole, a fixed contact and a corresponding movable contact, the movable contact being reversibly movable, along a corresponding translational displacement axis, between a decoupled position from the fixed contact and a coupled position with the fixed contact; an actuation assembly having, for each electric pole, an actuation shaft rotating about a rotation axis during a closing manoeuvre or an opening manoeuvre of the switching apparatus; for each electric pole, a motion transmission assembly including an eccentric mechanism operatively coupled with the actuation shaft.

20 Claims, 14 Drawing Sheets

(51) Int. Cl.
*H01H 3/26* (2006.01)
*H01H 3/42* (2006.01)

(58) Field of Classification Search
CPC .. H01H 3/42; H01H 3/32; H01H 3/54; H01H 33/66; H01H 3/28; H01H 3/3015
USPC ..... 218/124, 120, 118, 123, 140, 153, 154
See application file for complete search history.

(56) References Cited

U.S. PATENT DOCUMENTS 5,422,450 A * 6/1995 Miyazawa ..... H01H 33/666 218/140
6,917,006 B2 * 7/2005 Bachofen ..... H01H 3/3052 200/318.2
8,779,318 B2 * 7/2014 Espeseth ..... H01H 3/02 218/124
9,373,456 B2 * 6/2016 Yang ..... H01H 3/3015

OTHER PUBLICATIONS

Translation DE532639 (Original doc. published Sep. 3, 1931) (Year: 1931).*
European Patent Office, International Search Report & Written Opinion issued in corresponding Application No. PCT/EP2018/050829, dated Apr. 24, 2018, 12 pp.
European Patent Office, Extended Search Report issued in corresponding Application No. 17154638.5, dated Apr. 13, 2017, 7 pp.

* cited by examiner

MEDIUM VOLTAGE SWITCHING APPARATUS

The present invention relates to a switching apparatus for medium voltage electric systems.

For the purpose of the present application, the term "medium voltage" (MV) relates to operating voltages at electric power distribution level, which are higher than 1 kV AC and 1.5 kV DC up to some tens of kV, e.g. up to 72 kV AC and 100 kV DC.

MV electric systems typically adopt two different kinds of switching apparatuses.

A first type of switching apparatuses, including for example circuit breakers or disconnectors, is basically designed for protection purposes, namely for carrying (for a specified time interval) and breaking currents under specified abnormal circuit conditions, e.g. under short circuit conditions.

A second type of switching apparatuses, including for example contactors, is basically designed for manoeuvring purposes, namely for carrying and breaking currents under normal circuit conditions including overload conditions.

As is known, in most traditional switching apparatuses, driving systems including spring operated mechanisms and/or electromagnetic actuators are typically adopted for moving the movable contacts.

These switching apparatuses suffer of some drawbacks.

Very often, it is quite difficult to ensure a stable and repeatable switching of the electric contacts during an opening manoeuvre or a closing manoeuvre of the switching apparatus.

Friction phenomena, changes in environmental conditions, changes in operational conditions of the components, and the like, may in fact have a strong influence on the operation of the driving system moving the movable contacts.

The above mentioned problems often result in relevant wear phenomena of the electric contacts with a reduction of the operational life of these latter and a consequent need of frequent maintenance interventions.

Another drawback of these traditional switching apparatuses is represented by frequent over-travel or back-travel phenomena of the movable contacts, which may lead to the onset of relevant mechanical stresses on the kinematic chain driving the movable contacts and, in switching apparatuses of the vacuum operating type, on the bellows sealing the vacuum bulbs, with a consequent reduction of the operational life of these parts of the switching apparatus.

In the attempt of solving or mitigating the above mentioned drawbacks, traditional switching apparatuses often employ mechanical dampers or other mechanical arrangements to provide an improved control of the motion of the movable contacts during an opening or closing manoeuvre of the switching apparatus.

However, these solutions generally entail a higher complexity of the kinematic chain operatively coupled with the movable contacts with consequent increase of the overall occupied volumes and of the industrial manufacturing time and costs of the switching apparatus.

More recent switching apparatuses employ driving systems for moving the movable contacts, which include electric motors with a closed control loop, e.g. servomotors.

In general, these apparatuses represent an important improvement with respect to spring operated or magnetically operated switching apparatuses since they can offer a much higher degree of control of the motion of the movable contacts.

However, currently available switching apparatuses of this type adopt complicated solutions to mechanically couple the electric motor with the movable contacts, which still offer poor performances in terms of structural compactness and in terms of reliability in transmitting motion to the movable contacts.

The main aim of the present invention is to provide a switching apparatus for MV electric systems that allows solving or mitigating the above mentioned problems.

More in particular, it is an object of the present invention to provide a switching apparatus having an improved driving system for the movable contacts, which provides an improved motion control, high precision and reliability in actuating the movable contacts during an opening manoeuvre or a closing manoeuvre.

Still another object of the present invention is to provide a switching apparatus that is provided with a driving system having high compactness and structural simplicity.

Still another object of the present invention is to provide a switching apparatus that can be easily manufactured at industrial level, at competitive costs with respect to the solutions of the state of the art.

In order to fulfill these aim and objects, the present invention provides a switching apparatus, according to the following claim 1 and the related dependent claims.

Characteristics and advantages of the invention will emerge from the description of preferred, but not exclusive embodiments of the switching apparatus, according to the invention, non-limiting examples of which are provided in the attached drawings, wherein.

With reference to the figures, the present invention relates to a switching apparatus 1 for medium voltage (MV) electric systems.

The switching apparatus 1 may be a circuit breaker, a disconnector, a contactor, or another similar device.

The switching apparatus 1 may be of the vacuum operating type, as shown in the cited figures, or a gas insulated switching device.

The switching apparatus 1 comprises a pole section 11 and a basement 12, which respectively include the electric poles and the main actuation components of the switching apparatus.

Figure 1:
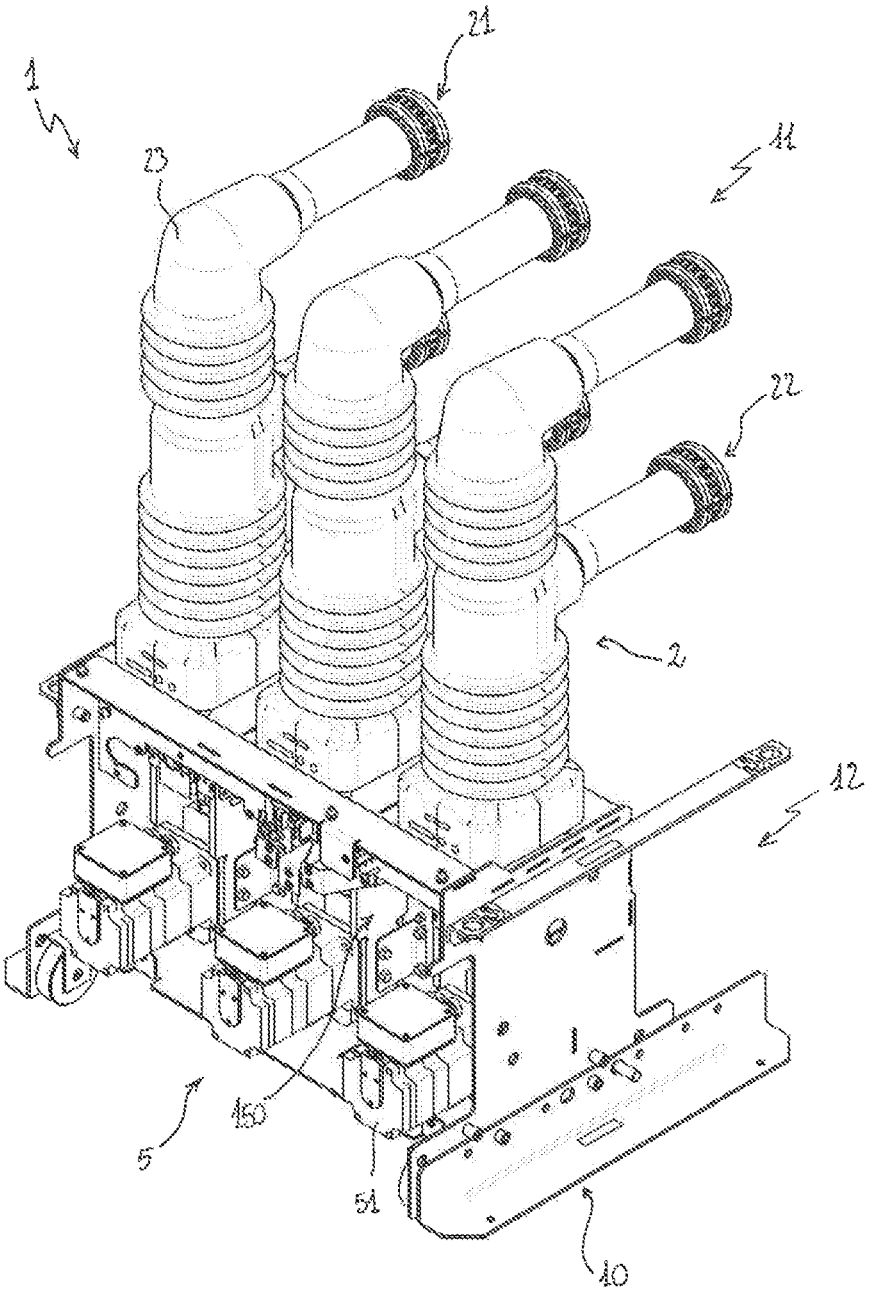
FIG. 1-2, 2A, 3-8 are schematic views of the switching apparatus, according to the invention.
Figure 2:
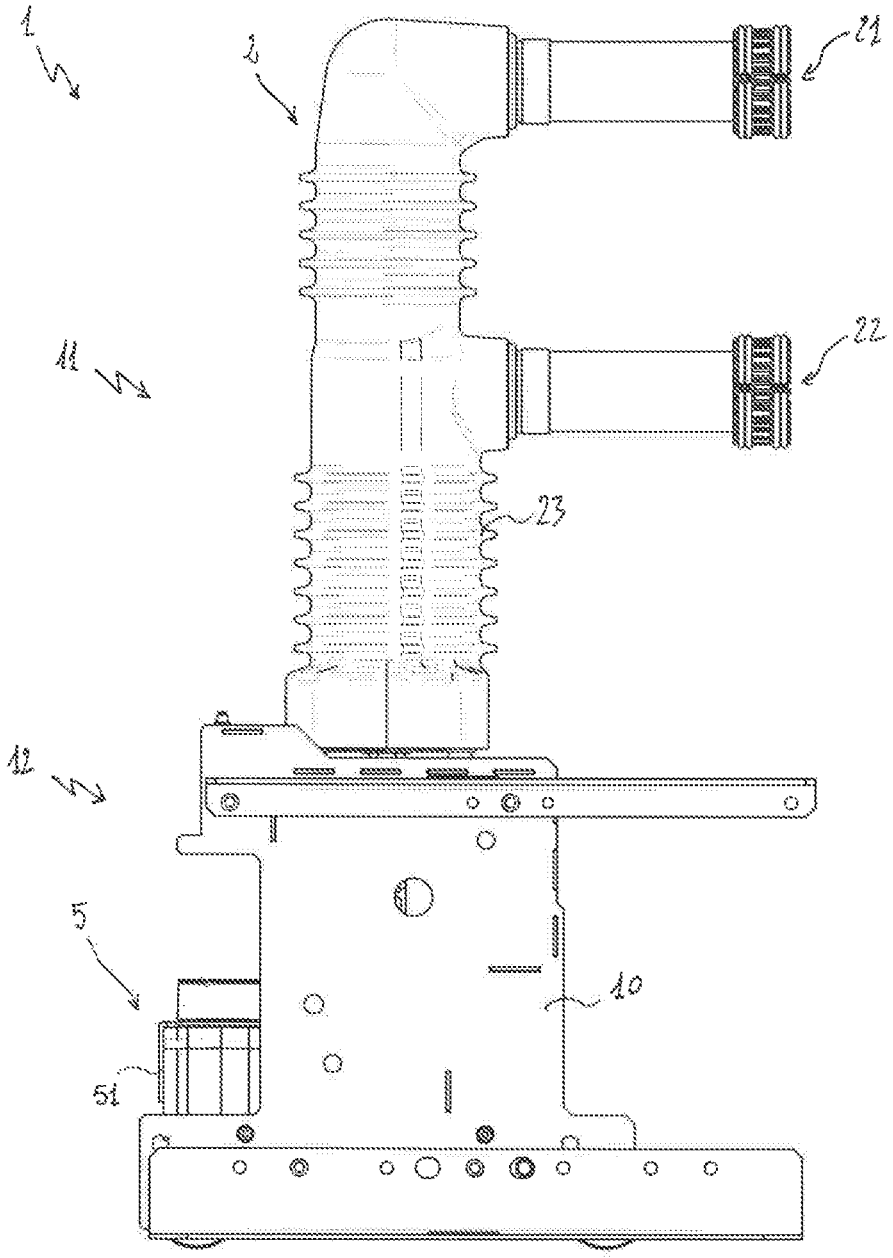
Figure 3:
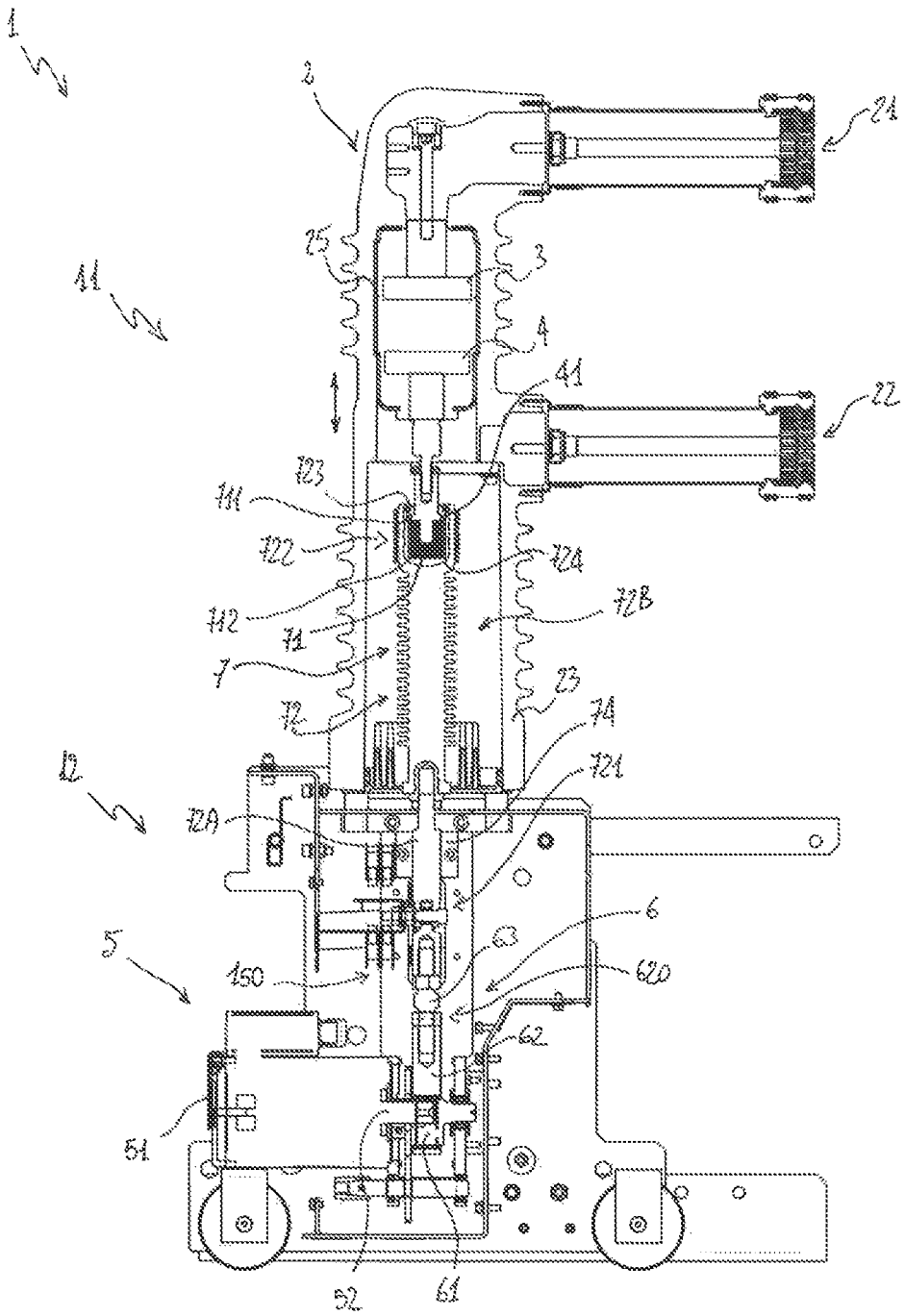
Figure 4:
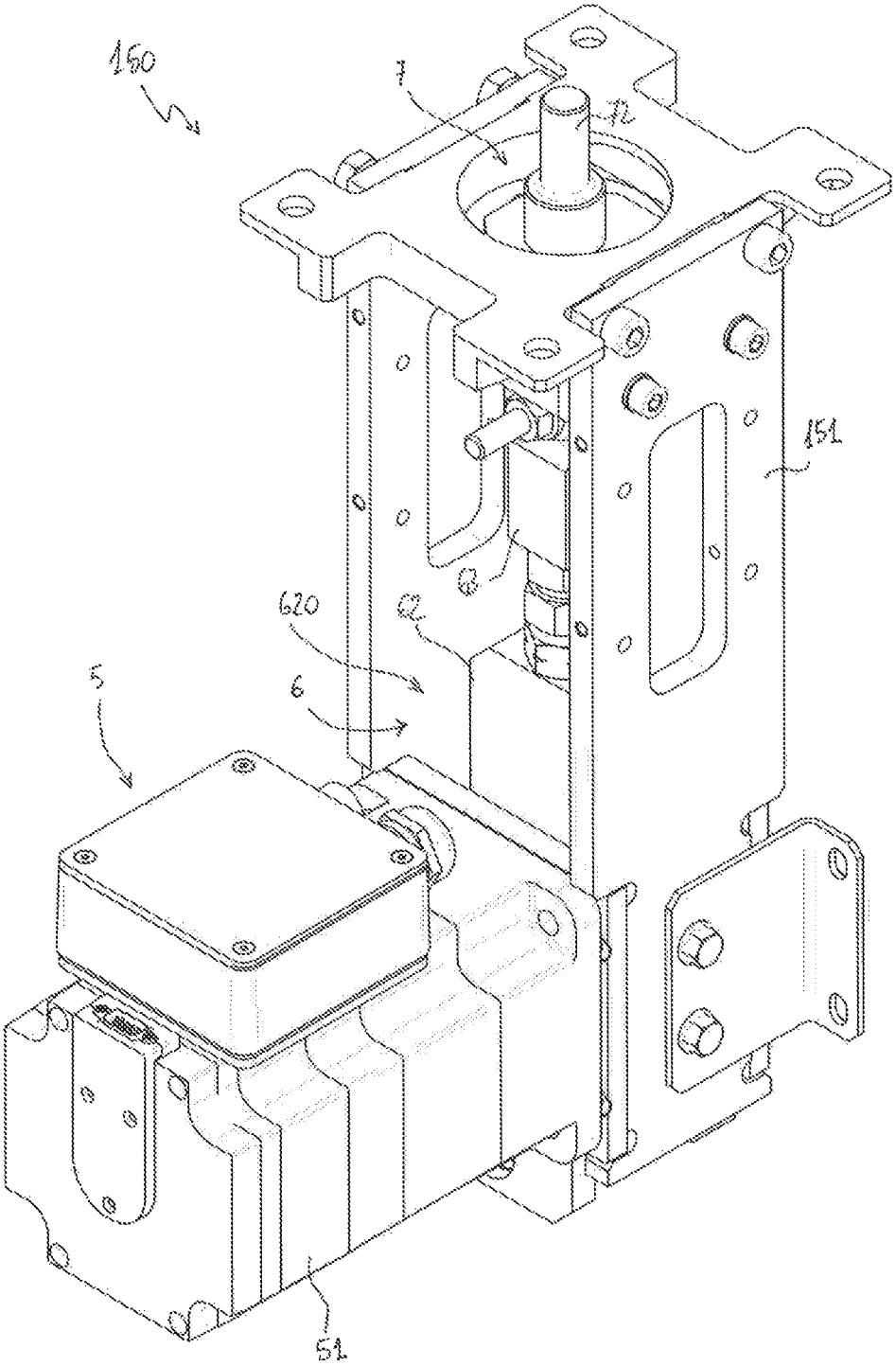

Taking as a reference a normal installation position of the switching apparatus 1, shown in FIGS. 1-3, the pole section 11 is overlapped to the basement 12.

Conveniently, the switching apparatus 1 comprises an outer frame 10, which may at least be partially made of electrically insulating material of known type.

The outer frame 10 is adapted to be fixed to a support (not shown) during the installation of the switching apparatus 1.

The switching apparatus 1 comprises one or more electric poles 2.

Preferably, the switching apparatus 1 is of the multi-phase (e.g. three-phase) type, thereby comprising a plurality (e.g. three) of electric poles 2.

Preferably, each electric pole 2 comprises a corresponding insulating housing 23, which are conveniently fixed to the basement 12 of the switching apparatus.

The insulating housings 23 of the electric poles 2 form corresponding portions of the outer frame 10 at the pole section 11 of the switching apparatus.

Preferably, each insulating housing 23 is formed by an elongated (e.g. cylindrical) hollow body of electrically insulating material of known type.

Preferably, each insulating housing 23 defines an internal volume, in which the components of the corresponding electric pole 2 are accommodated.

Advantageously, each electric pole 2 comprises a first pole terminal 21 and a second pole terminal 22, which may be mechanically fixed to the housing 23 by means of suitable flanges. The pole terminals 21, 22 are adapted to be electrically connected with a corresponding electric conductor (e.g. a phase conductor) of an electric line.

The insulating housing 23 and the pole terminals 21, 22 of the electric poles 2 of the switching apparatus 1 may be of known type and will not here described in more details for the sake of brevity.

For each electric pole 2, the switching apparatus 1 comprises a fixed contact 3 and a movable contact 4, which are in electrical connection with the first and second pole terminals 21, 22 respectively.

Figure 5:
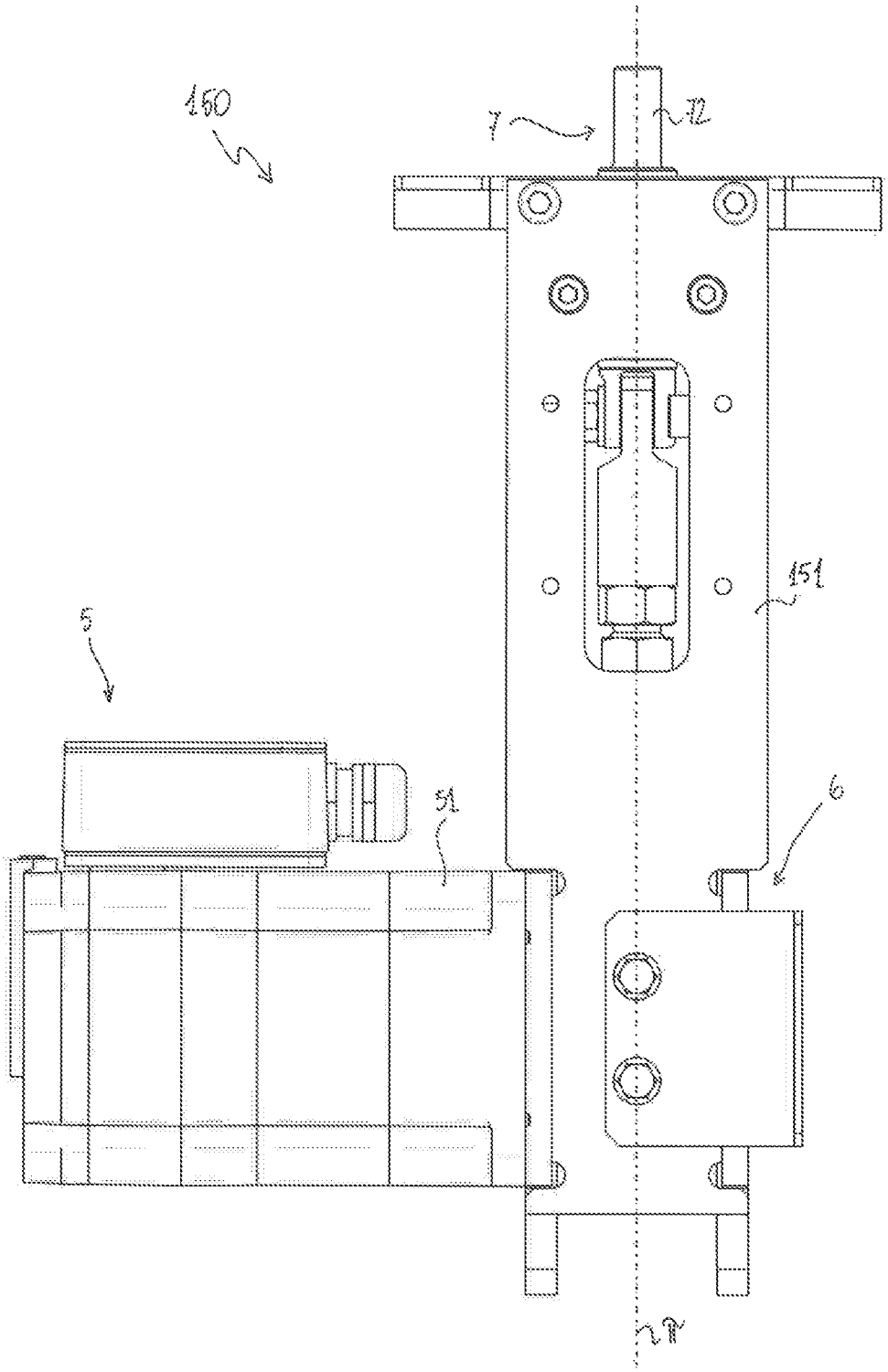
Figure 6:
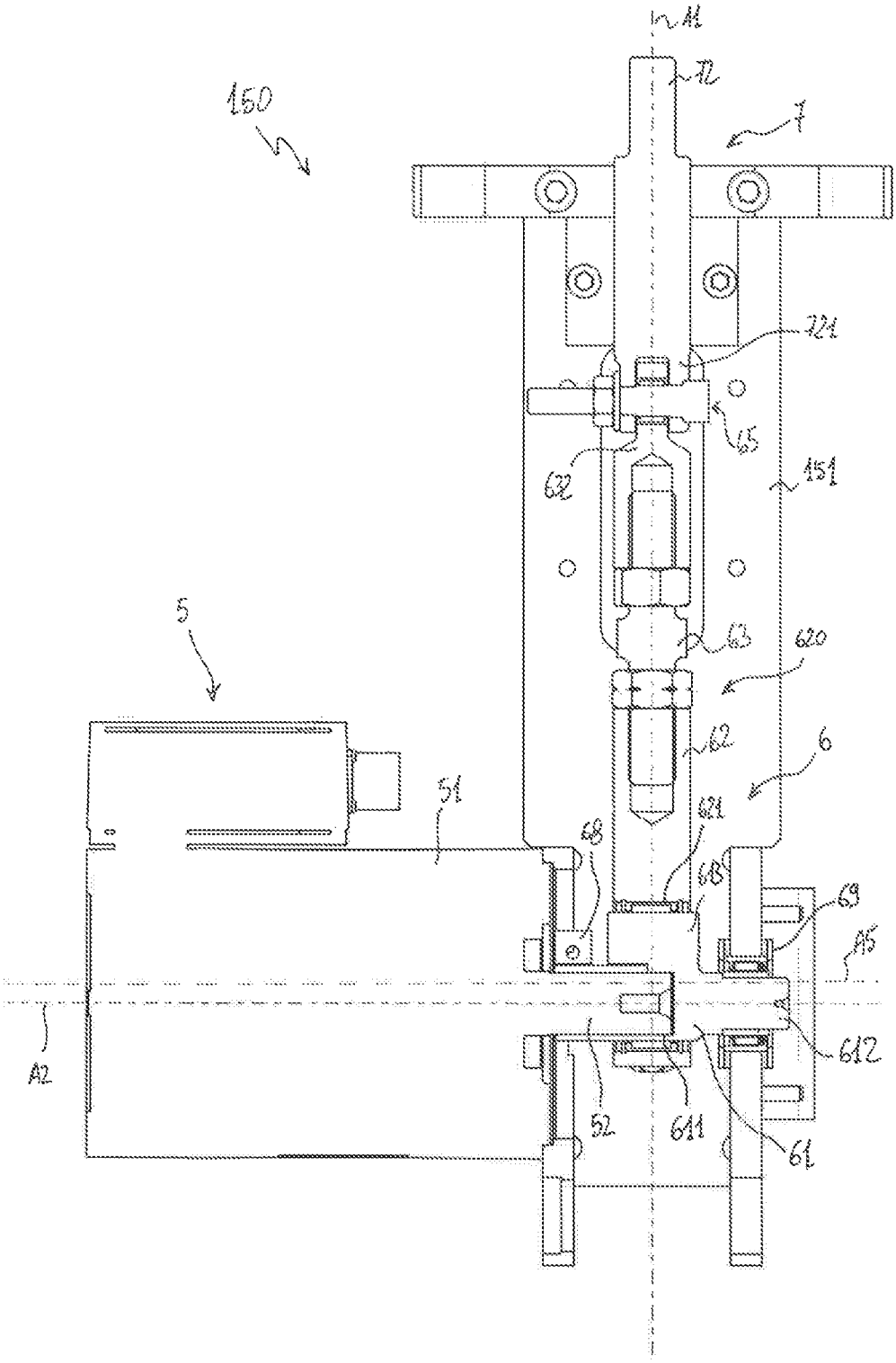
Figure 7:
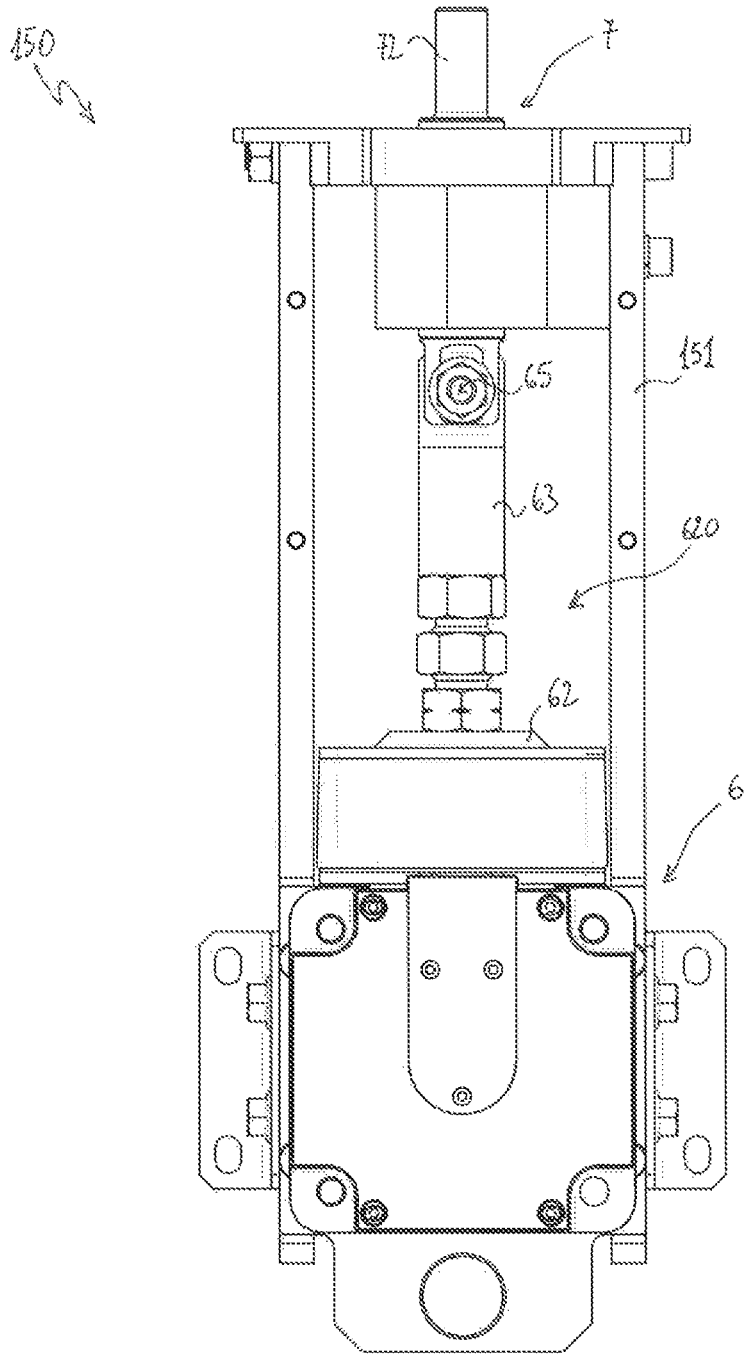

Each movable contact 4 is reversibly movable along a corresponding displacement axis A1, which conveniently forms the main longitudinal axes of the corresponding electric pole 2 (FIGS. 5, 6).

Preferably, the displacement axes A1 of the movable contacts 4 are mutually parallel and lye on a common displacement plane.

In particular, each movable contacts 4 is reversibly movable (see the corresponding bidirectional displacement arrow FIG. 3) between a decoupled position (opening position) from the corresponding fixed contact 3 and a coupled position (closing position) with the corresponding fixed contact 3.

The passage of the movable contacts 4 from the coupled position with to the decoupled position from the corresponding fixed contacts 3 represents an opening manoeuver of the switching apparatus 1 whereas the passage of the movable contacts 4 from the decoupled position from to the coupled position with the corresponding fixed contacts 3 represents a closing manoeuver of the switching apparatus 1.

The electric contacts 3, 4 of the switching apparatus 1 may be of known type and will not here described in more details for the sake of brevity.

Preferably, the switching apparatus 1 is of the vacuum operating type as shown in the cited figures.

In this case, for each electric pole 2, the switching apparatus 1 comprises a vacuum chamber 25, in which a corresponding pair of movable and fixed contacts 3, 4 is placed and can be mutually coupled/decoupled.

The vacuum chambers 25 may be of known type and will not here described in more details for the sake of brevity.

The switching apparatus 1 comprises an actuation assembly 5 providing actuation forces to actuate the movable contacts 4 (FIG. 6).

In particular, the actuation assembly comprises, for each electric pole, an actuation shaft 52 capable of providing mechanical forces to actuate the movable contacts 4 during an opening manoeuvre or a closing manoeuvre of the switching apparatus.

Each rotation shaft 52 rotates about a rotation axis A2, which is preferably perpendicular to the displacement axis A1 of the movable contacts 4.

Each rotation shaft 52 thus provides rotational mechanical forces to actuate the movable contact 4 of the corresponding electric pole 2 during an opening manoeuvre or a closing manoeuvre of the switching apparatus.

Preferably, as shown in the cited figures, the actuation assembly 5 comprises, for each electric pole, an electric motor 51 having an actuation shaft 52 as output shaft (as shown in the cited figures) or, alternatively, having its output shaft mechanically coupled to a corresponding actuation shaft 52 by means of a suitable gear mechanism.

In alternative embodiments of the invention (not shown), however, the actuation assembly 5 may comprise a single electric motor having its output shaft mechanically coupled to the actuation shaft 52 corresponding to each electric pole 2 by means of suitable gear mechanisms.

Figure 2A:
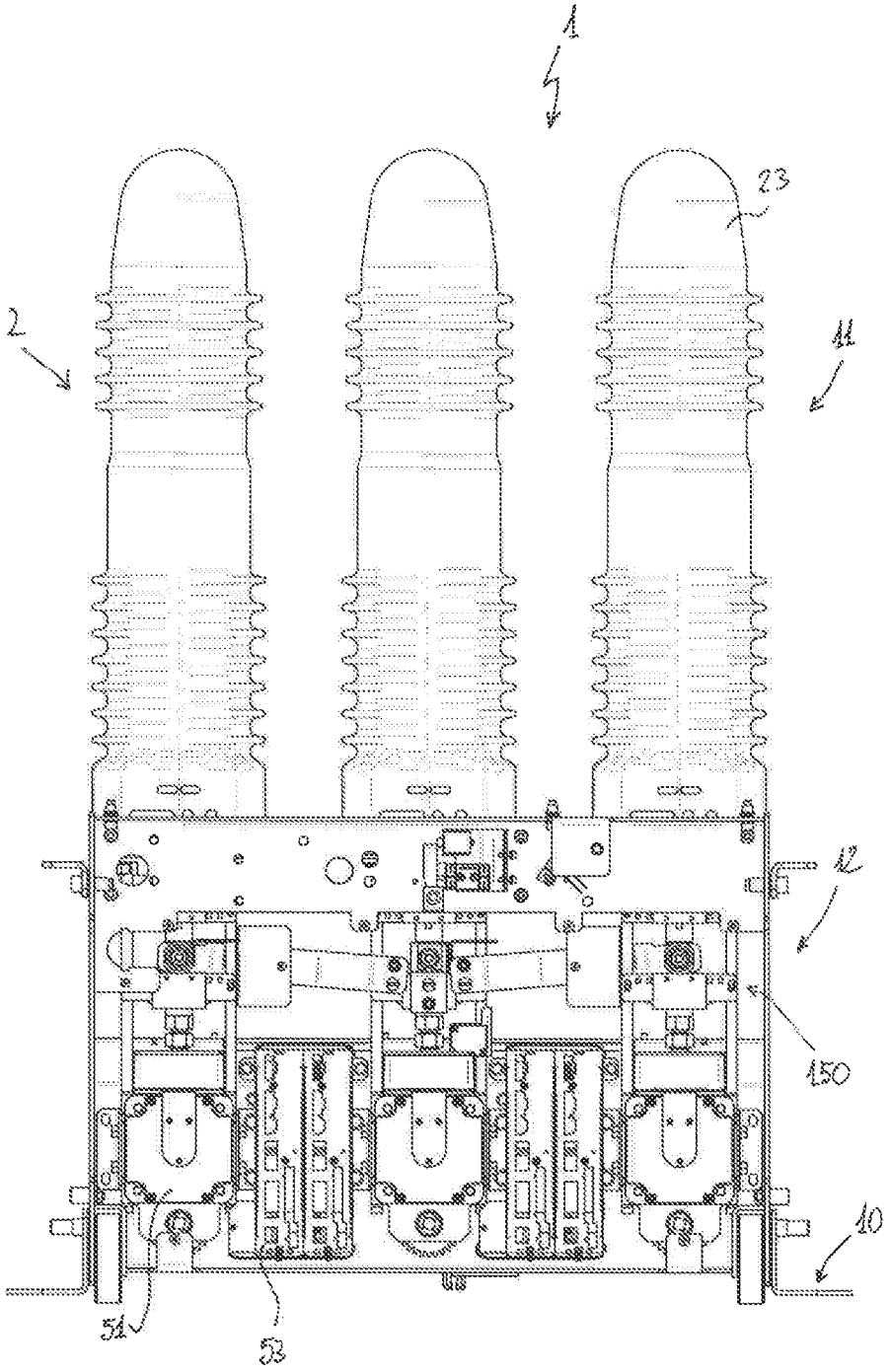

Preferably, as shown in the cited figures, the actuation assembly 5 comprises, for each electric motor 51, a power and control unit 53 (FIG. 2A).

Preferably, each power and control unit 53 comprises suitable electric circuits to feed the corresponding electric motor 51 and suitable electronic circuits (e.g. including on or more digital processing unit, such as microprocessors) to control operation of the corresponding electric motor 51.

In alternative embodiments of the invention (not shown), however, the actuation assembly 5 may comprise a single power and control unit 53 for all the electric motor 51.

For each electric pole, the switching apparatus 1 comprises a motion transmission assembly 150 including a corresponding eccentric mechanism 6 and a corresponding transmission mechanism 7.

Preferably, each motion transmission assembly 150 comprises a corresponding supporting frame 151, conveniently fixed to the outer frame 10 of the switching apparatus.

In the embodiments in which the switching apparatus 1 comprises an electric motor 5 for each electric pole 2, each electric motor 5 may be fixed to the supporting frame 151 of a corresponding motion transmission assembly 150, as shown in the cited figures.

As mentioned above, the switching apparatus 1 comprises, for each electric pole, an eccentric mechanism 6 operatively coupled with a corresponding actuation shaft 52 so as to be actuated by this latter.

Each eccentric mechanism 6 is arranged in such a way to be actuated by rotational mechanical forces provided by the corresponding actuation shaft 52 and provides, in turn, translational mechanical forces to actuate the movable contact 4 of the corresponding electric pole 2 during an opening manoeuvre or a closing manoeuvre of the switching apparatus.

As mentioned above, the switching apparatus 1 comprises, for each electric pole, a transmission mechanism 7 operatively coupled with a corresponding eccentric mechanism 6 so as to be actuated by this latter.

Each transmission mechanism 7 is arranged in such a way to be actuated by translational mechanical forces provided by the corresponding eccentric mechanism 6 and transmit, in turn, translational mechanical forces to the movable contact 4 of the corresponding electric pole 2 during an opening manoeuvre or a closing manoeuvre of the switching apparatus.

During an opening manoeuvre or a closing manoeuvre of the switching apparatus, each eccentric mechanism 6 is movable between a first end-of-run position P1 (FIG. 9), at which the corresponding movable contact 4 is decoupled from the respective fixed contact 3, and a second end-of-run position P2 (FIG. 13), at which the corresponding movable contact 4 is coupled to the respective fixed contact 3.

Each eccentric mechanism 6 reaches its first end-of-run position P1 at the end of an opening manoeuvre of the switching apparatus and stably maintains said first end-of-run position until a closing manoeuvre of the switching apparatus is carried out.

Each eccentric mechanism 6 reaches its second end-of-run position P2 at the end of a closing manoeuvre of the switching apparatus and stably maintains said second end-of-run position until an opening manoeuvre of the switching apparatus is carried out.

Preferably, during an opening manoeuvre or a closing manoeuvre of the switching apparatus, each eccentric mechanism 6 passes through a first deadlock position PD1 (FIG. 10), at which the corresponding movable contact 4 is decoupled from the respective fixed contact 3 and reaches a point of maximum distance from said fixed contact.

Preferably, during an opening manoeuvre or a closing manoeuvre of the switching apparatus, each eccentric mechanism 6 passes through a second deadlock position PD2 (FIG. 12), at which the corresponding movable contact 4 is coupled with the respective fixed contact 3 and a corresponding contact spring 71 of the transmission mechanism 7, operatively coupled with said movable contact, stores a maximum amount of elastic energy (FIG. 3).

Preferably, during a closing manoeuvre of the switching apparatus, each eccentric mechanism 6:

- leaves the first end-of-run position P1, at which the corresponding movable contact 4 is decoupled from the fixed contact 3 and is spaced from said fixed contact of a distance shorter than the maximum distance reached by the movable contact 4 when the eccentric mechanism 6 is in the first deadlock position PD1;
- passes through the first deadlock position PD1;
- passes through a first intermediate position PH at which the movable contact 4 couples with the fixed contact 3;
- passes through the second deadlock position PD2;
- reaches the second end-of-run position P2, at which the corresponding movable contact 4 is coupled (with a given coupling pressure) with the respective fixed contact 3 and the respective contact spring 71, which is coupled with said movable contact, stores an amount of elastic energy lower than the maximum amount of elastic energy, which is stored when the eccentric mechanism 6 is in the second deadlock position PD2.

Preferably, during an opening manoeuvre of the switching apparatus, each eccentric mechanism 6:

- leaves the second end-of-run position P2, at which the corresponding movable contact 4 is coupled with the respective fixed contact 3 and the respective contact spring 71, coupled with said movable contact, stores an amount of elastic energy lower than the maximum amount of elastic energy, which is stored when the eccentric mechanism 6 is in the second deadlock position PD2;
- passes through the second deadlock position PD2;
- passes through a second intermediate position PI2 at which the movable contact 4 decouples from the fixed contact 3 (FIG. 11);
- passes through the first deadlock position PD1;
- reaches the first end-of-run position P1, at which the corresponding movable contact 4 is decoupled from the fixed contact 3 and is spaced from said fixed contact of a distance (sufficient to avoid re-striking or arching phenomena) shorter than the maximum distance reached by the movable contact 4 when the eccentric mechanism 6 is in the first deadlock position PD1.

In the following, the eccentric mechanism 6, which is arranged at each electric pole of the switching apparatus, is described in more details with particular reference to the preferred embodiment shown in the cited figures.

Preferably, the eccentric mechanism 6 comprises an eccentric body 61 mechanically coupled with a corresponding actuation shaft 52 so as to solidly rotate with this latter.

Preferably, the eccentric mechanism 6 comprises a clamping element 68 for the mechanical coupling between the corresponding eccentric body 61 and actuation shaft 52. In this way the eccentric body 61 and the corresponding actuation shaft 52 can rotate together as a single piece.

Conveniently, the eccentric body 61 comprises an eccentric axis A5 parallel to the rotation axis A2 and spaced from this latter (FIG. 6).

Figure 8:
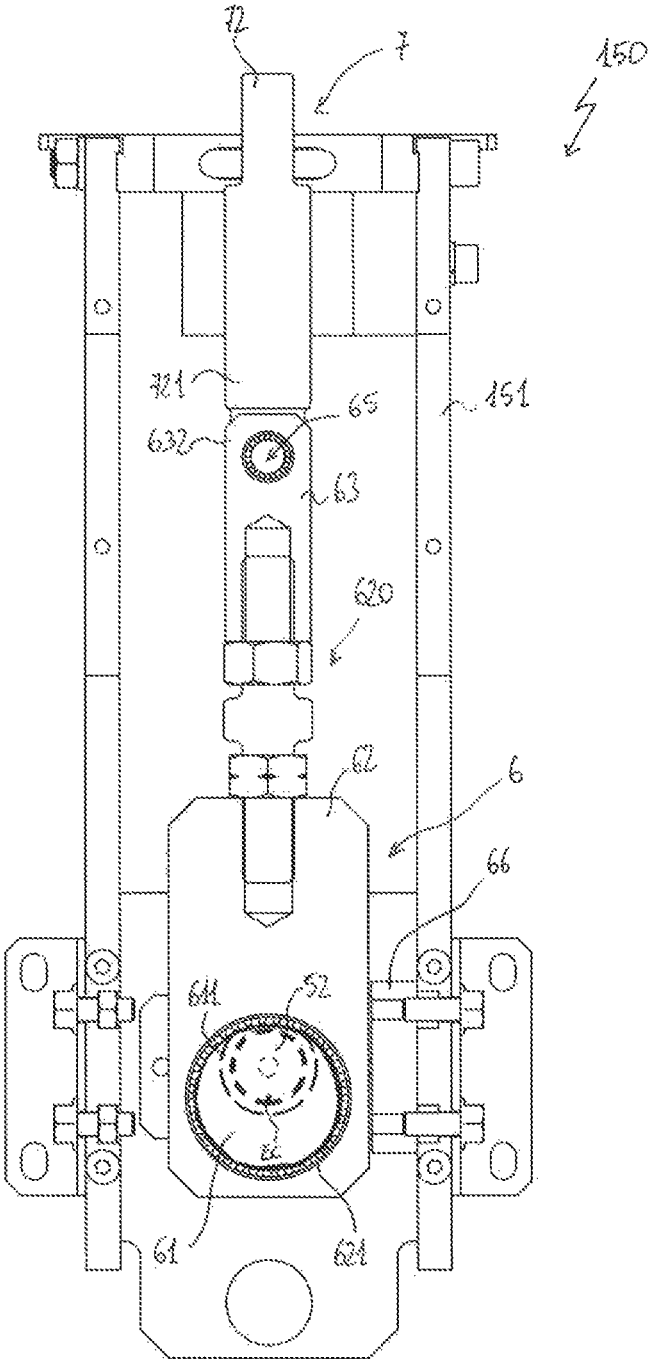
Figure 11:
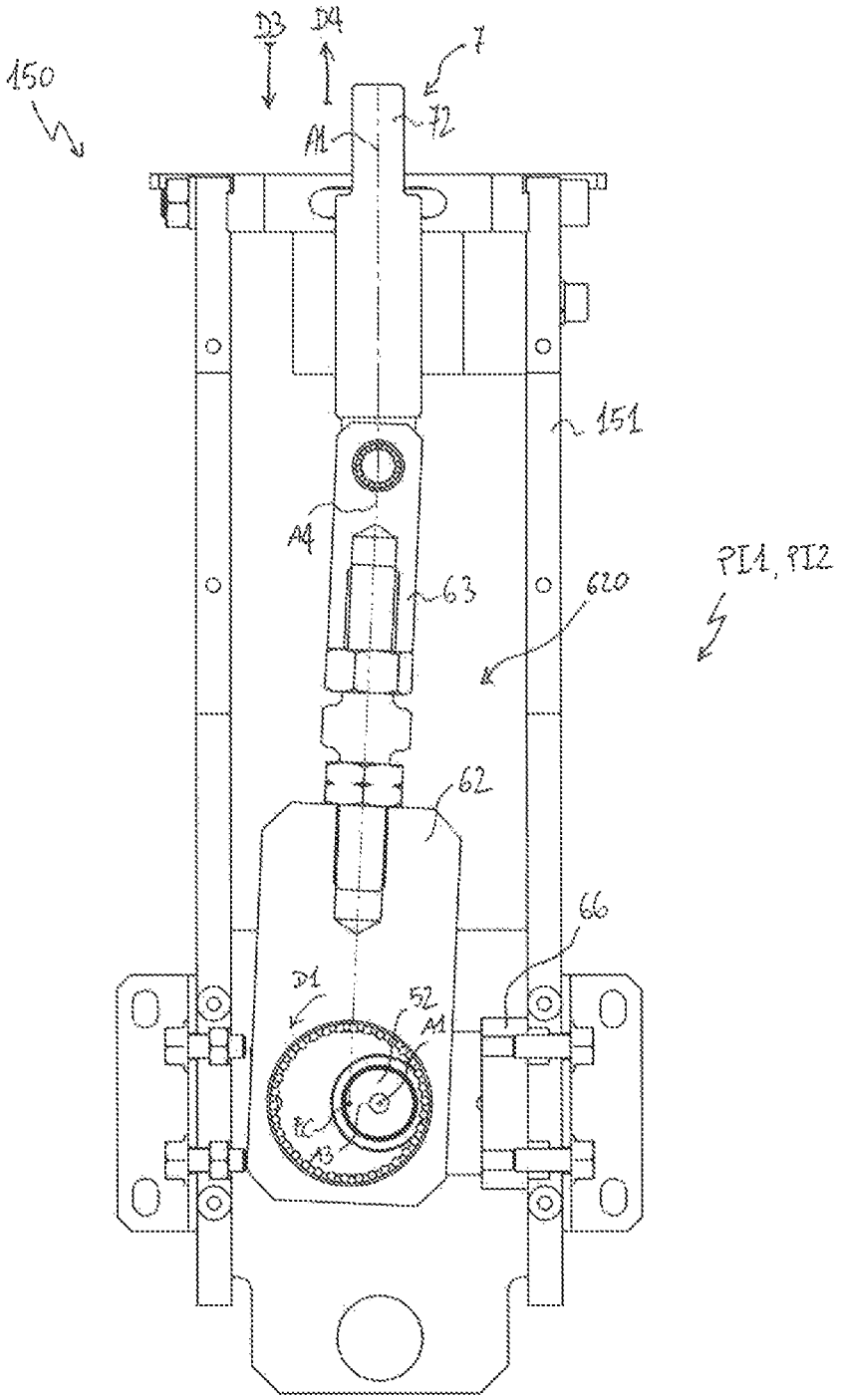

On a plane $\pi$ perpendicular to the rotation axis A2 of the actuation shaft 52 (e.g. including the displacement axis A1), the eccentric axis A5 of the eccentric body 52 defines an eccentric centre EC of the eccentric body 52 (FIGS. 5, 8, 11).

Conveniently, the eccentric body 61 comprises a crank axis A3 passing through the eccentric centre EC and the rotation axis 52 on a plane $\pi$ perpendicular to this latter (FIGS. 5, 11).

As will be better described in the following, the crank axis A3 is aligned with the displacement axis A1 when the eccentric mechanism 6 is the deadlock positions PD1, PD2.

Preferably, the eccentric body 61 comprises a first shaped cavity 611 coaxial with the corresponding actuation shaft 52, in particular with the rotation axis A2 of this latter (FIG. 6).

Preferably, the first shaped cavity 611 is a blind cavity having a cylindrical shape.

Preferably, the actuation shaft 52 is at least partially inserted within the first cavity 611 for mechanical coupling with the eccentric body 61.

In the cited figures, a preferred embodiment for such an eccentric body 61 is shown (FIGS. 6, 8).

According to such an embodiment, the eccentric body 61 comprises a main portion 613 extending along the eccentric axis A5.

Preferably, the main portion 613 is made by a solid piece of material (e.g. steel) with a cylindrical symmetry along the eccentric axis A5.

On a first side of the main portion 613, which faces the actuation shaft 52, the eccentric body 61 preferably comprises the first shaped cavity 611.

On a second side of the main portion 613, which is opposite to said first side, the eccentric body 61 preferably comprises a shaped protrusion 612 coaxial with the first cavity 611 and the corresponding actuation shaft 52 accommodated therein, along the rotation axis 52.

Preferably, the shaped protrusion 612 has a cylindrical shape and forms a single piece with said main portion 613.

Preferably, the eccentric mechanism 6 comprises a bearing element 69 in a fixed position (e.g. conveniently fixed to the supporting frame 151), to which the shaped protrusion 612 is mechanically coupled at a distal end from the main portion 613.

Conveniently, the shaped protrusion 612 is mechanically coupled with the bearing element 69 in such a way to be free to rotate together with the eccentric body 61 and the actuation shaft 52.

The above described embodiment for the eccentric body 61 allows remarkably reducing possible mechanical plays thereby ensuring a stable and correct positioning of the eccentric body 61 along the rotation axis A2.

Further, the assembly formed by the eccentric body 61 and the actuation shaft 52 is particularly robust and compact from a structural point of view.

Preferably, each eccentric mechanism 6 of the switching apparatus comprises a connecting rod body 620 mechanically coupled with the eccentric body 61 so as to be rotatably movable with respect to this latter.

Preferably, the connecting rod body 620 comprises a connecting rod axis A4 on a plane n perpendicular to the rotation axis A2 of the actuation shaft 52 (FIG. 11).

As will be better described in the following, the connecting rod axis A4 is aligned with the displacement axis A1 when the eccentric mechanism 6 is the deadlock positions PD1, PD2.

As it will be better illustrated in the following, the eccentric axis A3 and the connecting rod axis A4 form, along a plane π perpendicular to the rotation axis A2, a first angle α or a second angle α' (preferably α=α') having an absolute value of few degrees (e.g. lower or equal to 5°) when the eccentric mechanism 6 reaches the first end-of-run position P1 or the second end-of-run position P2, respectively.

As it will be better illustrated in the following, this feature, which is obtained respectively thanks to an over-rotation of eccentric mechanism 6 beyond the first deadlock position PD1 or the second deadlock position PD2, contributes to ensure that the first end-of-run position P1 or the second end-of-run position P2 are stably maintained by the eccentric mechanism 6 at the end of a closing or opening manoeuvre of the switching apparatus.

It is evidenced that, when the eccentric mechanism 6 is in the first end-of-run position P1, the over-rotation of a small angle α implies a small reduction of the distance between the movable contact 4 and the electric contact 3 with respect to the maximum stroke reached when the eccentric mechanism 6 is in the first deadlock position PD1.

It is further evidenced that, when the eccentric mechanism 6 is in the second end-of-run position P2, the over-rotation of a small angle α' implies a small reduction of the elastic energy stored by the contact spring 71 with respect to the maximum elastic energy stored when the eccentric mechanism 6 is in the second deadlock position PD2.

Preferably, the connecting rod body 620 comprises a second shaped cavity 621 coaxial with the eccentric body 61, in particular with the eccentric axis A5 of this latter (FIG. 6).

Preferably, the second shaped cavity 621 is a pass-through cavity having a cylindrical shape.

Preferably, the eccentric body 61 (in particular its main portion 613) is at least partially inserted within the second cavity 621 for mechanical coupling with the rod body 62.

Preferably, the connecting rod body 620 comprises a bearing coupling arrangement (e.g. of the ball bearing, needle bearing or roller bearing type) in the second cavity 621 for mechanical coupling with the eccentric body 61, in particular with the main portion 613 of this latter.

In this way, when the eccentric body 61 rotates together with the actuation shaft 52, the connecting rod body 620 can swing with respect to the eccentric body 61 (in a same relative direction) about the eccentric axis A5 of this latter.

Preferably, the connecting rod body 620 is rotatably coupled with the transmission mechanism 7 at a hinging point 65.

Preferably, the eccentric mechanism 6 comprises an end-of-run element 66 in a fixed position, e.g. conveniently fixed to the supporting frame 151.

Figure 13:
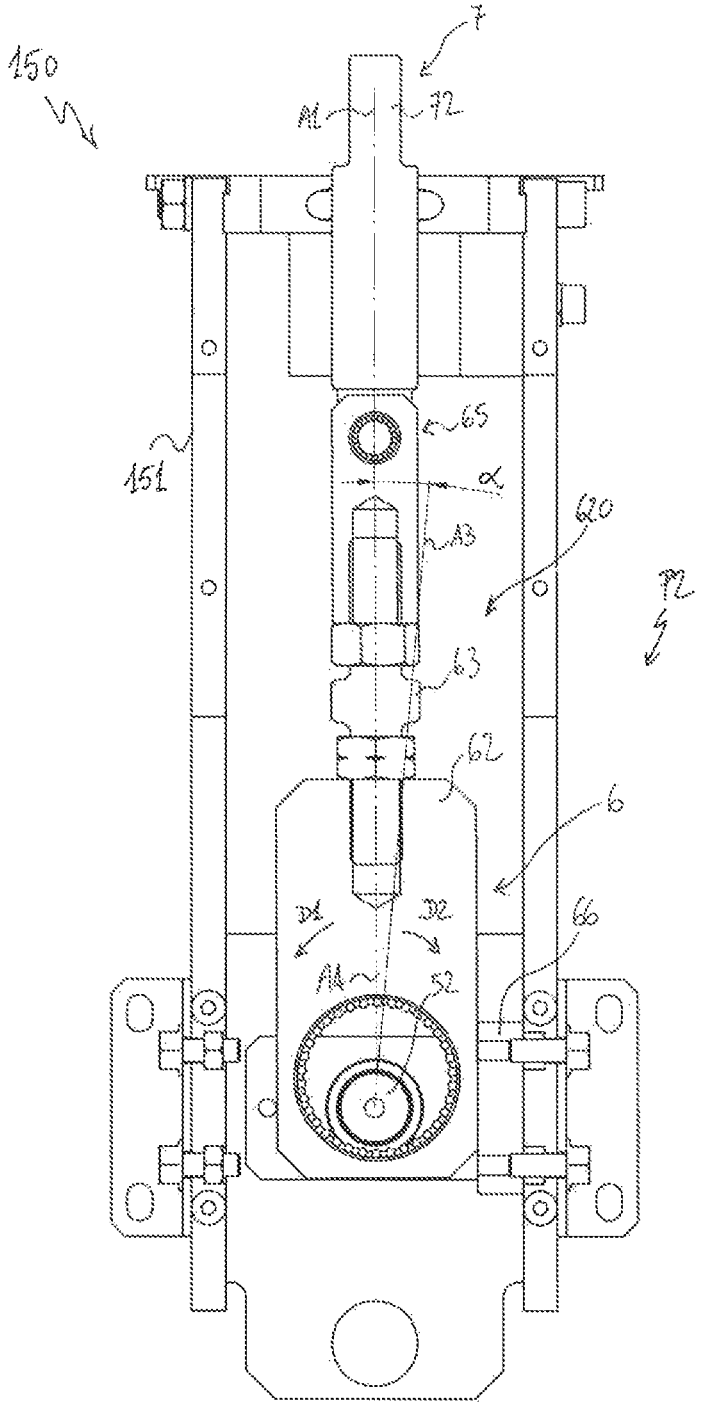

As it will be better illustrated in the following, the connecting rod body 62 abuts against the end-of-run element 66 when the eccentric mechanism 6 reaches the first end-of-run position P1 (FIG. 9) or the second end-of-run position P2 (FIG. 13).

The arrangement of the end-of-run element 66 contributes to ensure that the first end-of-run position P1 or the second end-of-run position P2 are stably maintained by the eccentric mechanism 6 at the end of a closing or opening manoeuvre of the switching apparatus.

Preferably, in the eccentric mechanism 6, the distance between the hinging point 65 of mechanical connection with the transmission mechanism 7 and the eccentric centre EC of the eccentric body 61, along a plane π perpendicular to the rotation axis A2 of the actuation shaft 52, is much longer than the maximum distance (maximum stroke) that the movable contact 4 can reach with respect to the fixed contact 3 during a closing or opening manoeuvre of the switching apparatus.

As an example, such a distance may be at least ten time longer that the maximum stroke available for the movable contact 4.

It has been verified by the inventors that such a solution allows remarkably reducing mechanical stresses on the eccentric mechanism 6 (in particular the presence of lateral forces acting on the connecting rod body 620).

Further, the provision of a lengthened connecting rod body 620 allows reducing the mechanical energy that the actuation assembly 5 has to provide to move the movable contacts 4.

In the cited figures, a preferred embodiment for the connecting rod body 620 is shown (FIGS. 6, 8, 11).

According to such an embodiment, the connecting rod body 620 comprises a main portion 62 made by a solid piece of material (e.g. steel) and extending, preferably with a tetrahedral symmetry, along the connecting rod axis A4.

The main portion 62 comprises the second shaped cavity 621 passing through the thickness of said main portion.

On a distal end with respect to the second cavity 621, the connecting rod body 620 comprises an elongated portion 63 extending along the connecting rod axis A4.

Preferably, the elongated portion 63 of the connecting rod body 620 is formed by a shaped rod extending longitudinally along the connecting rod axis A4, as shown in the cited figures.

At one end, the shaped rod 63 is solidly coupled with the main portion 62 of the connecting rod body 620.

At an opposite end 632, distally from the main portion 62, the shaped rod 63 is rotatably coupled with the transmission mechanism 7 at the hinging point 65.

As an alternative, the elongated portion 63 may be formed by a protrusion made in one piece with the main portion 62 of the connecting rod body 620.

In the following, the transmission mechanism 7, which is arranged at each electric pole of the switching apparatus, is described in more details with particular reference to the preferred embodiment shown in the cited figures (FIGS. 3, 6).

Preferably, the transmission mechanism 7 comprises a plunger member 72 and a contact spring 71.

The plunger member 72 extends longitudinally along the displacement axis A1 and has opposite first and second ends 721, 722 respectively at a distal position from and a proximal position with the movable contact 4.

The first end 721 of the plunger member is mechanically coupled with the eccentric mechanism 6, more particularly with the connecting rod body 620 of this latter, at the hinging point 65.

The second end 722 of the plunger member 72 abuts against the contact spring 72 of the transmission mechanism 7 and the movable contact 4.

The contact spring 71 is arranged along the displacement axis A1 coaxially with the plunger member 72.

Proximally to the movable contact 4, the contact spring 71 has a first end 711 mechanically coupled (e.g. solidly fixed) with said movable contact whereas, distally from the movable contact 4, the contact spring 71 has a second end 712 abutting against the plunger member 72, in particular with the second end 722 of this latter.

During a closing or opening manoeuvre of the switching apparatus, the plunger member 72 can move relatively with respect the movable contact 4, when this latter is coupled with the fixed contact 3. Such a relative movement is made possible by the presence of the contact spring 71, which, in fact, is subject to compression or release thereby storing or releasing elastic energy.

Preferably, the contact spring 71 is mounted on the movable contact 4 in such a way to be in a biasing state (i.e. slightly compressed) even when the movable contact 4 is decoupled from the fixed contact 3.

Preferably, the plunger member 72 is formed by a shaped rod at least partially made of electrically insulating material.

As shown in the cited figures, the movable plunger 72 may comprise multiple portions (even made of different materials) joined together and aligned along the displacement axis A1.

Preferably, the plunger member 72 comprises a first portion 72A (e.g. made of steel) distally positioned from the movable contact 4 and including the first end 721.

Conveniently, the portion 72A of the plunger member is accommodated in a volume defined by the supporting frame 151 of the motion transmission assembly 150.

Preferably, the plunger member 72 comprises a second portion 72B (e.g. made of electrically insulating material) proximally positioned to the movable contact 4 and including the second end 722.

Conveniently, the portion 72B of the plunger member protrudes from the supporting frame 151 of the motion transmission assembly 150 and is accommodated in the housing member 23 of electric pole 2.

Preferably, the second end 722 of the plunger member (at the second portion 72B thereof) is cup-shaped and defines a volume for accommodating at least partially the contact spring 71.

Preferably, the second end 722 of the plunger member comprises a first coupling surface 723, which mechanically couples with the movable contact 4, in particular with a second coupling surface 41 of this latter during an opening manoeuvre of the switching apparatus.

Conveniently, said first and second coupling surfaces are formed respectively by a shaped edge 723 of the second end 722 of the plunger member and a shaped edge 41 of the movable contact, which are arranged in such a way to mutually abut during an opening manoeuvre of the switching apparatus.

Preferably, the second end 722 of the plunger member comprises a third coupling surface 724, which mechanically couples with the contact spring 71, in particular with the second end 712 of this latter, during a closing manoeuvre of the switching apparatus.

Conveniently, the mentioned coupling surfaces 724 is formed by a bottom portion of the cup-shaped end 722 of the plunger member.

Preferably, the transmission mechanism 7 comprises one or more guide or axial bearing elements 74 slidingly coupled with the plunger member to ensure the correct alignment of this latter with the displacement axis A1.

The operation of the switching apparatus 1 for an electric pole 2 is now described in more details.

Opening State of the Switching Apparatus

Figure 9:
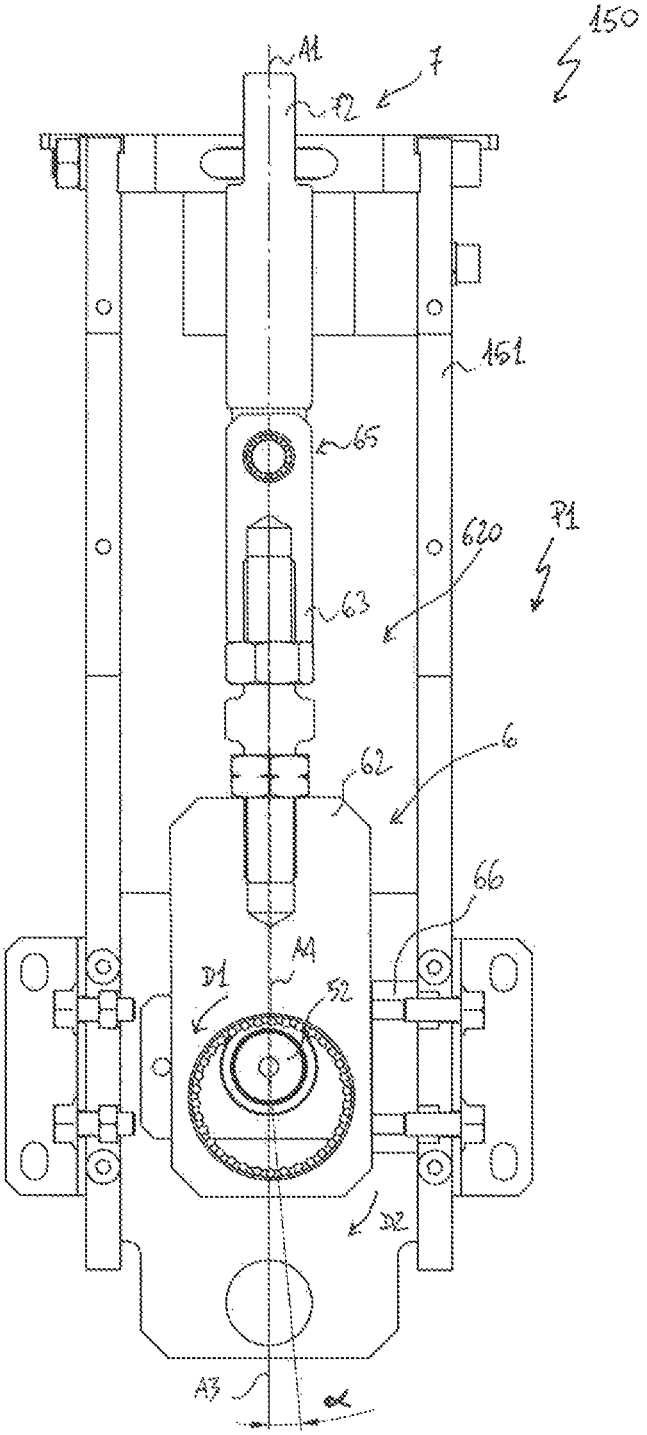
FIG. 9-13 are schematic views to illustrate operation of the switching apparatus, according to the invention.

When the switching apparatus 1 is in an opening state, the movable contact 4 is decoupled from the fixed contact 3 and is spaced from this latter of a distance slightly shorter (few hundredths of mm) than the maximum distance (maximum stroke) that can be reached by said movable contact (FIGS. 2, 9).

The contact spring 71 is not compressed (with respect to its biasing state).

The eccentric mechanism 6 is in the first end-of-run position P1.

The connecting rod body 620 of the eccentric mechanism 6 abuts against the guide element 66.

The connecting rod axis A4 of the connecting rod body 620 is not aligned with the displacement axis A1 of the movable contact The eccentric axis A3 of the eccentric body 61 and the connecting rod axis A4 of the connecting rod body 620 form a first angle $\alpha$ of few degrees (e.g. lower or equal to 5°).

The electric motor 5 can be switched off as the eccentric mechanism 6 is capable of stably maintaining the first end-of-run position P1 until a closing manoeuvre of the switching apparatus is carried out.

The abutment of the connecting rod body 620 against the end-of-run element 66 prevents any movement of the eccentric mechanism 6 in the rotation direction D1.

On the other hand, as the eccentric axis A3 and the connecting rod axis A4 are not mutually aligned, any force directed to move the movable contact 4 towards the fixed contact 3 (e.g. the vacuum force caused by the pressure difference between the inside and the outside of the vacuum chamber) has a lateral component opposing to a movement of the eccentric mechanism in the rotation direction D2.

Such a lateral component stably maintains the connecting rod body 620 in the abutment position against the guide element 66 until the electric motor 51 is activated in order to carry out a closing manoeuvre.

Closing Manoeuvre

In order to carry out a closing manoeuvre, the electric motor 51 is activated and the actuation shaft is rotated according to the rotation direction D2 (FIG. 9).

The connecting rod body 620 leaves its in abutment position against the guide element 66 and rotates according to the same rotation direction D2 as any force opposing the movement of the eccentric mechanism 6 in the rotation direction D2 is overcome by the forces exerted by the actuation shaft 52.

Figure 10:
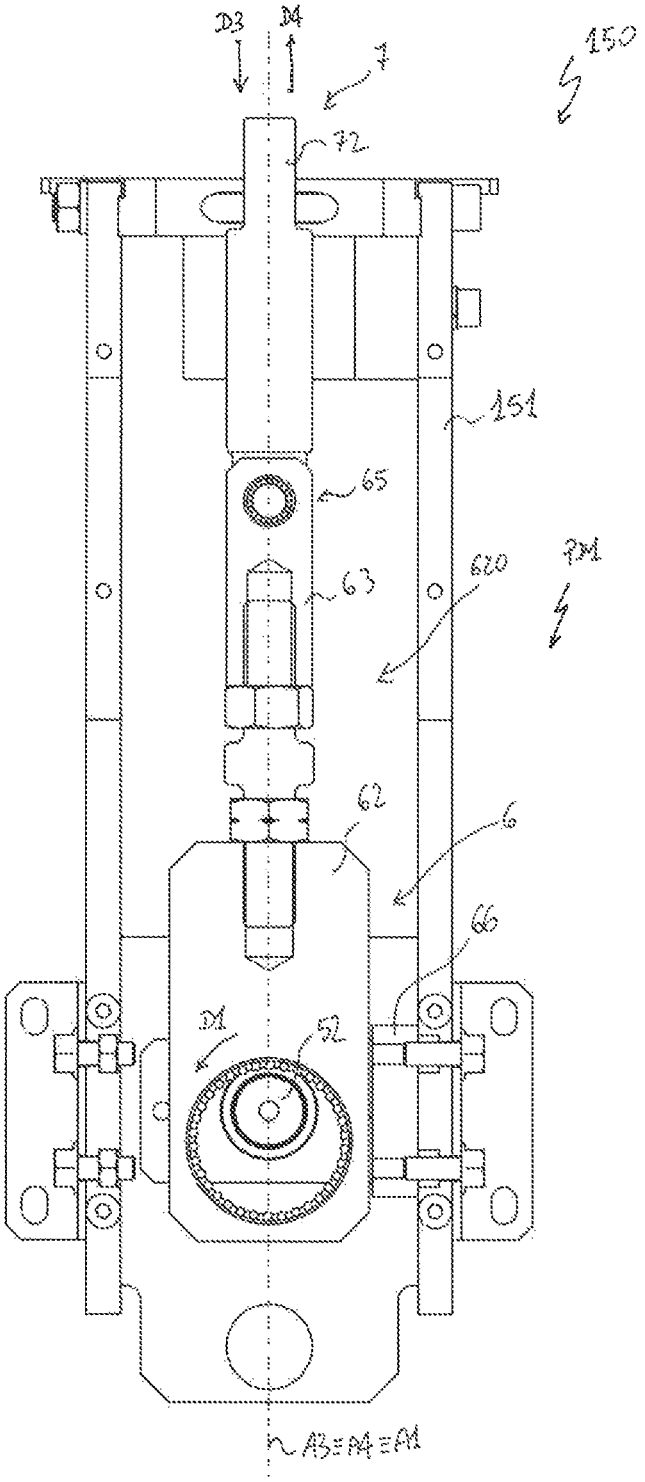

The eccentric mechanism 6 thus moves towards the first deadlock position PD1 (FIGS. 9, 10).

During the movement of the eccentric mechanism 6 between the first end-of-run position P1 and the first deadlock position PD1, the movable plunger 72 slightly moves (some hundredths of mm) according to the translation direction D3 (along the displacement axis A1) thereby further distancing the movable contact 4 from the fixed contact 3 (FIG. 10).

When the first deadlock position PD1 is reached by the eccentric mechanism 6, the eccentric axis A3, the connecting rod axis A4 and the displacement axis A1 are mutually aligned and the movable contact 4 reaches its maximum distance from the fixed contact 3.

As it is moved by the actuation shaft 52, the eccentric mechanism 6 passes over the first deadlock position PD1 and moves towards the second deadlock position PD2.

The movable plunger 72 moves according to the translation direction D4 (along the displacement axis A1) thereby moving the movable contact 4 towards the fixed contact 3 (FIG. 11).

During its movement between the first deadlock PD1 and the second deadlock position PD2, the eccentric mechanism 6 reaches a first intermediate position PI1, at which the movable contact 4 couples with the fixed contact 3.

During the movement of the eccentric mechanism 6 between the first end-of-run position P1 and the intermediate position PI, as the movable contact 4 is not coupled with the fixed contact 3, the contact spring 71 is not compressed (with respect to its biasing state) and it moves solidly with the movable plunger 72 and the movable contact 4.

As it is still moved by the actuation shaft 52, the eccentric mechanism 6 passes over the first intermediate position PI1 and continues to move towards the second deadlock position PD2.

During the movement of the eccentric mechanism 6 between the first intermediate position PI1 and the second deadlock position PD2, the plunger member 72 moves (according to the direction D4) relatively with respect the movable contact 4 and the contact spring 71 is subject to compression.

Figure 12:
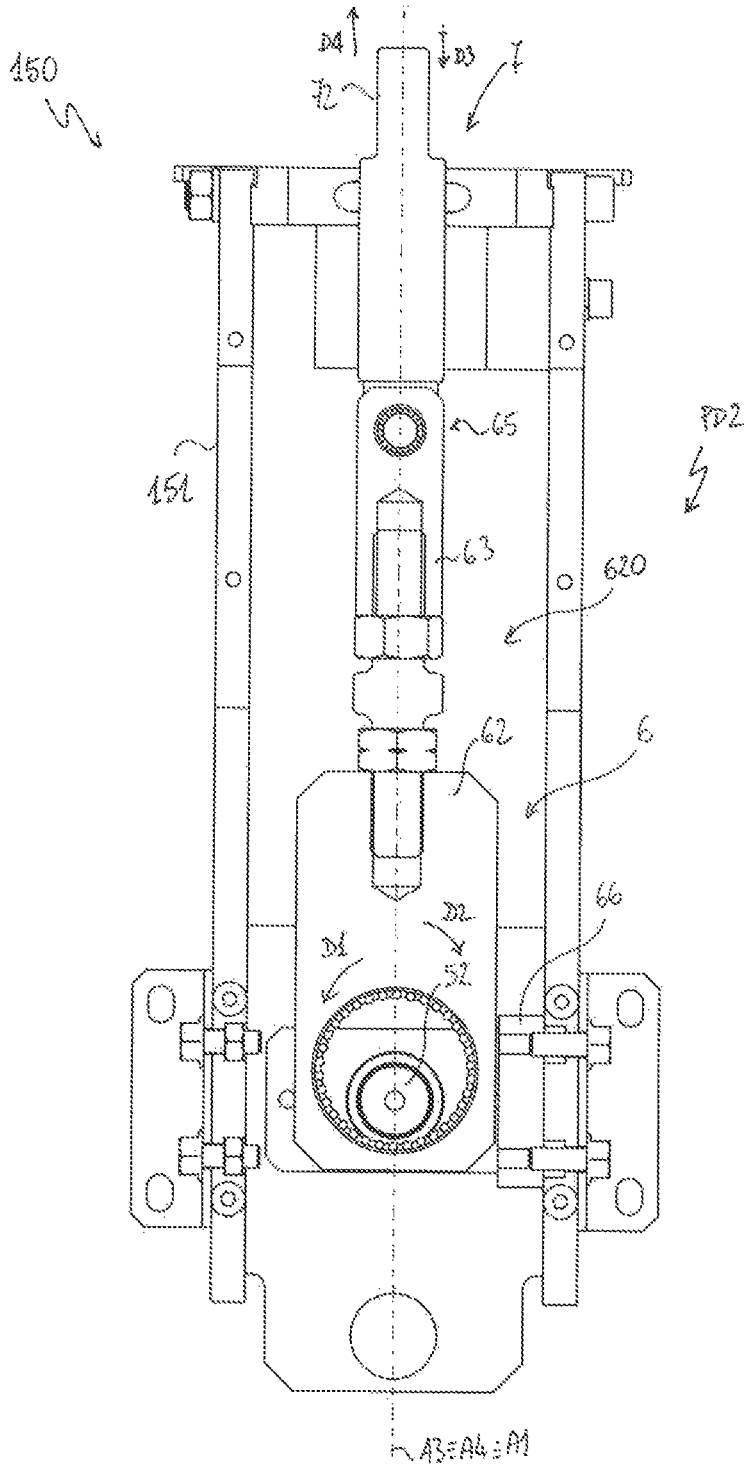

When the second deadlock position PD2 is reached by the eccentric mechanism 6, the eccentric axis A3, the connecting rod axis A4 and the displacement axis A1 are mutually aligned and the contact spring 71 reaches its maximum compression (FIG. 12).

As it is moved by the actuation shaft 52, the eccentric mechanism 6 passes over the second deadlock position PD2 and moves towards the second end-of-run position P2 (over-rotation with respect to the second deadlock position PD2).

During the movement of the eccentric mechanism 6 between the second deadlock position PD2 and the second end-of-run position P2, the movable plunger 72 slightly moves (some hundredths of mm), according to the direction D3, relatively with respect the movable contact 4.

The contact spring 71 releases some elastic energy with respect to the maximum compression state reached with the eccentric mechanism 6 at the second deadlock position PD2.

The closing manoeuvre ends when the eccentric mechanism 6 reaches the second end-of-run position P2 (FIG. 12).

Closing State of the Switching Apparatus

When the switching apparatus 1 is in a closing state, the movable contact 4 is coupled from the fixed contact 3 (FIG. 13).

The contact spring 71 is compressed but it stores an amount of elastic energy lower than the maximum amount of elastic energy stored with the eccentric mechanism 6 at the second deadlock position PD2.

The connecting rod body 620 of the eccentric mechanism 6 abuts against the guide element 66.

The connecting rod axis A4 of the connecting rod body 620 is not aligned with the displacement axis A1 of the movable contact.

The eccentric axis A3 of the eccentric body 61 and the connecting rod axis A4 of the connecting rod body 620 form a second angle α' of few degrees (e.g. lower or equal to 5°).

The electric motor 5 can be switched off as the eccentric mechanism 6 is capable of stably maintaining the second end-of-run position P2 until an opening manoeuvre of the switching apparatus is carried out.

The abutment of the connecting rod body 620 against the end-of-run element 66 prevents this latter from moving (eccentrically with respect to the actuation shaft 52) in the rotation direction D2.

On the other hand, as the eccentric axis A3 and the connecting rod axis A4 are not mutually aligned, any force directed to move the movable contact 4 away from the fixed contact (e.g. the weight force of the movable plunger 72) has a lateral component directed in such a way to oppose a movement of the eccentric mechanism 6 in the rotation direction D1.

Such a lateral component stably maintains the connecting rod body 620 in the abutment position against the guide element 66 until the electric motor 51 is activated in order to carry out an opening manoeuvre.

Opening Manoeuvre

In order to carry out an opening manoeuvre, the electric motor 51 is activated and the actuation shaft is rotated according to the rotation direction D1 (FIG. 13).

The connecting rod body 620 leaves its in abutment position against the guide element 66 and rotates in the same rotation direction D1 as any force opposing the movement of the connecting rod body 620 is overcome by the forces exerted by the actuation shaft 52.

The eccentric mechanism 6 moves towards the second deadlock position PD2 (FIGS. 12, 13). During the movement of the eccentric mechanism 6 between the second end-of-run position P2 and the second deadlock position PD2, the movable plunger 72 slightly moves relatively (some hundredths of mm) with respect the movable contact 4 according to the translation direction D4.

The contact spring 71 is slightly compressed with respect to the compression state reached with the eccentric mechanism 6 at the second end-of-run position P2.

When the second deadlock position PD2 is reached by the eccentric mechanism 6, the eccentric axis A3, the connecting rod axis A4 and the displacement axis A1 are mutually aligned and the contact spring 71 reaches its maximum compression state.

As it is moved by the actuation shaft 52, the eccentric mechanism 6 passes over the second deadlock position PD2 and moves towards the second deadlock position PD1.

During the movement of the eccentric mechanism 6 between the second deadlock position PD2 and the first deadlock position PD1, the movable plunger 72 moves relatively with respect the movable contact 4 according to the translation direction D3.

The contact spring 71 releases elastic energy with respect to the maximum compression state reached with the eccentric mechanism 6 at the second deadlock position PD2.

During its movement from the second deadlock position PD2 to the first deadlock position PD1, the eccentric mechanism 6 reaches a second intermediate position PI2 (which preferably coincides with the first intermediate position PI1), at which the movable contact 4 decouples from the fixed contact 3.

When the eccentric mechanism 6 reaches second intermediate position PI2, the second end 722 of the plunger member 73 couples with the movable contact 4 and the movable contact 4 is dragged away from the fixed contact 3 by the plunger member 72, along the translation direction D3, thereby decoupling from the fixed contact 3.

As it is still moved by the actuation shaft 52, the eccentric mechanism 6 passes over the second intermediate position PI2 and continues to move towards the second deadlock position PD2.

The connecting rod body 620 continues to be rotated in the rotation direction D1.

During the movement of the eccentric mechanism 6 from the second intermediate position PI2 and the first end-of-run position P1, as the movable contact 4 is no more coupled with the fixed contact 3, the contact spring 71 is not compressed (with respect to its biasing state) and it moves solidly with the plunger member 72 and the movable contact 4.

During the movement of the eccentric mechanism 6 from the second intermediate position PI2 and the first deadlock position PD1, the plunger member 72 moves away (according to the direction D3) with respect the fixed contact 3, as it is dragged by the plunger member 72.

When the first deadlock position PD1 is reached by the eccentric mechanism 6, the eccentric axis A3, the connecting rod axis A4 and the displacement axis A1 are mutually aligned and the movable contact 4 reaches its maximum distance from the fixed contact 3.

As it is moved by the actuation shaft 52, the eccentric mechanism 6 passes over the first deadlock position PD1 and moves towards the first end-of-run position P1 (over-rotation with respect to the first deadlock position PD1).

During the movement of the eccentric mechanism 6 between the first deadlock position PD1 and the first end-of-run position P1, the movable plunger 72 slightly moves (some hundredths of mm) according to the translation direction D4 along the displacement axis A1.

The movable contact 4 is thus slightly moved (some hundredths of mm) towards the fixed contact 4.

The opening manoeuvre ends when the eccentric mechanism 6 reaches the first end-of-run position P1.

The switching apparatus 1, according to the invention, provides remarkable advantages with respect to the known apparatuses of the state of the art.

The switching apparatus 1 is provided with a motion transmission assembly 150 that ensures top levels performances in actuating the movable contacts during an opening manoeuvre or a closing manoeuvre.

In particular, the eccentric mechanism 6 ensures high levels of motion control of the movable contacts and high precision and reliability.

The eccentric mechanism 6, arranged as illustrated above, allows decreasing the axial length of the motion transmission assembly with respect to the traditional solutions of the state of the art, with relevant benefits in terms of reduction of vibration and mechanical stresses.

The eccentric mechanism 6 allows obtaining a very compact, simple and robust motion transmission assembly to move the movable contacts with relevant benefits in terms of size optimization for the overall structure of the switching apparatus.

Thanks to the to the eccentric mechanism 6, the switching apparatus can maintain a closing or an opening state without energizing the actuation assembly 5 with consequent relevant reduction of the electric power consumption.

The switching apparatus 1, according to the invention, is thus characterised by high levels of reliability for the intended applications.

The switching apparatus 1, according to the invention, is of relatively easy and cheap industrial production and installation on the field.

The invention claimed is:

1. A switching apparatus for medium voltage electric systems, said apparatus comprising one or more electric poles, each electrically coupleable with a corresponding electric line, said switching apparatus comprising:

for each electric pole, a fixed contact and a corresponding movable contact, said movable contact being reversibly movable, along a corresponding translational displacement axis, between a decoupled position from said fixed contact and a coupled position with said fixed contact, said movable contact moving from said decoupled position to said coupled position during a closing manoeuvre of said switching apparatus, said movable contact moving from said coupled position to said decoupled position during an opening manoeuvre of said switching apparatus;

an actuation assembly having, for each electric pole, an actuation shaft rotating about a rotation axis during the closing manoeuvre or the opening manoeuvre of said switching apparatus;

for each electric pole, a motion transmission assembly including:

an eccentric mechanism operatively coupled with said actuation shaft, said eccentric mechanism being actuated by rotational mechanical forces provided by said actuation shaft to actuate said movable contact during the closing manoeuvre or the opening manoeuvre of said switching apparatus;

a transmission mechanism operatively coupled with said eccentric mechanism and with said movable contact, said motion transmission assembly being actuated by translational mechanical forces provided by said eccentric mechanism to actuate said movable contact during the closing manoeuvre or the opening manoeuvre of said switching apparatus;

wherein said eccentric mechanism is movable between a first end-of-run position, at which said movable contact is decoupled from said fixed contact, and a second end-of-run position, at which said movable contact is coupled to said fixed contact, during the opening manoeuvre or the closing manoeuvre of said switching apparatus, wherein said eccentric mechanism reaches said first end-of-run position at an end of the opening manoeuvre of said switching apparatus and stably maintains said first end-of-run position until the closing manoeuvre of said switching apparatus is carried out, wherein said eccentric mechanism reaches said second end-of-run position at another end of the closing manoeuvre of said switching apparatus and stably maintains said second end-of-run position until the opening manoeuvre of said switching apparatus is carried out, and wherein said eccentric mechanism comprises an end-of-run element in a fixed position, said end-of-run element preventing the eccentric mechanism from rotating in one direction in said first end-of-run position or said second end-of-run position, said eccentric mechanism thereby rotating in opposite directions during the opening manoeuvre and the closing manoeuvre.

2. The switching apparatus, according to claim 1, wherein during the opening manoeuvre or the closing manoeuvre of said switching apparatus, said eccentric mechanism passes through a first deadlock position, at which said movable contact is decoupled from said fixed contact and reaches a point of a maximum distance from said fixed contact.

3. The switching apparatus, according to claim 2, wherein during the opening manoeuvre or the closing manoeuvre of said switching apparatus, said eccentric mechanism passes through a second deadlock position, at which said movable contact is coupled with said fixed contact and a contact spring of said transmission mechanism, operatively coupled with said movable contact, stores a maximum amount of elastic energy.

4. The switching apparatus, according to claim 2, wherein during the closing manoeuvre of said switching apparatus, said eccentric mechanism leaves said first end-of-run position, at which said movable contact is decoupled from said fixed contact and is spaced from said fixed contact of a distance shorter than said maximum distance, passes through said first deadlock position, passes through a second deadlock position and reaches said second end-of-run position, at which said movable contact is coupled with said fixed contact and a contact spring stores an amount of elastic energy lower than a maximum amount of elastic energy.

5. The switching apparatus, according to claim 2, wherein during the opening manoeuvre of said switching apparatus, said eccentric mechanism leaves said second end-of-run position, at which said movable contact is coupled with said fixed contact and a contact spring stores an amount of elastic energy lower than a maximum amount of elastic energy, passes through a second deadlock position, passes through said first deadlock position and reaches said first end-of-run position, at which said movable contact is decoupled from said fixed contact and is spaced from said fixed contact of a distance shorter than said maximum distance.

6. The switching apparatus, according to claim 1, wherein during the opening manoeuvre or the closing manoeuvre of said switching apparatus, said eccentric mechanism passes through a second deadlock position, at which said movable contact is coupled with said fixed contact and a contact spring of said transmission mechanism, operatively coupled with said movable contact, stores a maximum amount of elastic energy.

7. The switching apparatus, according to claim 6, wherein during the closing manoeuvre of said switching apparatus, said eccentric mechanism leaves said first end-of-run position, at which said movable contact is decoupled from said fixed contact and is spaced from said fixed contact of a distance shorter than a maximum distance, passes through a first deadlock position, passes through said second deadlock position and reaches said second end-of-run position, at which said movable contact is coupled with said fixed contact and said contact spring stores an amount of elastic energy lower than said maximum amount of elastic energy.

8. The switching apparatus, according to claim 6, wherein during the opening manoeuvre of said switching apparatus, said eccentric mechanism leaves said second end-of-run position, at which said movable contact is coupled with said fixed contact and said contact spring stores an amount of elastic energy lower than said maximum amount of elastic energy, passes through said second deadlock position, passes through a first deadlock position and reaches said first end-of-run position, at which said movable contact is decoupled from said fixed contact and is spaced from said fixed contact of a distance shorter than a maximum distance.

9. The switching apparatus, according to claim 1, wherein during the closing manoeuvre of said switching apparatus, said eccentric mechanism leaves said first end-of-run position, at which said movable contact is decoupled from said fixed contact and is spaced from said fixed contact of a distance shorter than a maximum distance, passes through a first deadlock position, passes through a second deadlock position and reaches said second end-of-run position, at which said movable contact is coupled with said fixed contact and a contact spring stores an amount of elastic energy lower than a maximum amount of elastic energy.

10. The switching apparatus, according to claim 1, wherein during the opening manoeuvre of said switching apparatus, said eccentric mechanism leaves said second end-of-run position, at which said movable contact is coupled with said fixed contact and a contact spring stores an amount of elastic energy lower than a maximum amount of elastic energy, passes through a second deadlock position, passes through a first deadlock position and reaches said first end-of-run position, at which said movable contact is decoupled from said fixed contact and is spaced from said fixed contact of a distance shorter than said maximum distance.

11. The switching apparatus, according to claim 1, wherein said eccentric mechanism comprises:

an eccentric body coupled with said actuation shaft so as to rotate solidly with said actuation shaft, said eccentric body having, along a plane perpendicular to said rotation axis, an eccentric centre spaced from said rotation axis and a crank axis passing through said rotation axis and said eccentric centre;

a connecting rod body operatively coupled with said eccentric body so as to be rotatably movable with respect to said eccentric body, said connecting rod body extending longitudinally along a connecting rod axis and being rotatably coupled with said transmission mechanism at a hinging point of said connecting rod body.

12. The switching apparatus, according to claim 11, wherein an eccentric axis and said connecting rod axis form, along the plane perpendicular to said rotation axis, an angle having an absolute value of few degrees when said eccentric mechanism reaches said first end-of-run position or said second end-of-run position.

13. The switching apparatus, according to claim 12, wherein said angle has the absolute value lower than or equal to 5°.

14. The switching apparatus, according to claim 11, wherein a distance between said hinging point and said eccentric centre, along the plane perpendicular to said rotation axis, is much longer than a maximum distance that said movable contact can reach with respect to said fixed contact during the closing manoeuvre or the opening manoeuvre of said switching apparatus.

15. The switching apparatus, according to claim 11, wherein:

said eccentric body comprises a first cavity coaxial with said actuation shaft, said actuation shaft being at least partially inserted within said first cavity for mechanical coupling with said eccentric body;

said connecting rod body comprises a second cavity coaxial with said eccentric body, said eccentric body being at least partially inserted within said second cavity for mechanical coupling with said connecting rod body.

16. The switching apparatus, according to claim 11, wherein said connecting rod body abutting against said end-of-run element when said eccentric mechanism reaches said first end-of-run position or said second end-of-run position.

17. The switching apparatus, according to claim 1, wherein said transmission mechanism comprises:

a plunger member extending longitudinally along said displacement axis having opposite ends, a first end of said plunger member being operatively coupled with said eccentric mechanism;

a contact spring arranged along said displacement axis and having opposite ends, a first end of said contact spring being operatively coupled with said movable contact, a second end of said contact spring being operatively coupled with a second end of said plunger member.

18. The switching apparatus, according to claim 17, wherein the second end of said plunger member moves relatively with respect to said movable contact during the opening manoeuvre or the closing manoeuvre of said switching apparatus, said contact spring is subject to compression or release during a relative movement of the second end of said plunger member with respect to said movable contact.

19. The switching apparatus, according to claim 17, wherein the second end of said plunger member is cup-shaped to define a volume for accommodating at least partially said contact spring, said second end comprising a first coupling surface for mechanical coupling with said movable contact during the opening manoeuvre of said switching apparatus, said second end comprising a third coupling surface for mechanical coupling with said contact spring during the closing manoeuvre of said switching apparatus.

20. The switching apparatus, according to claim 1, wherein the switching apparatus is of a vacuum operating type.

* * * * *